US010882336B2

(12) United States Patent
Schoenberger et al.

(10) Patent No.: US 10,882,336 B2
(45) Date of Patent: Jan. 5, 2021

(54) METHOD FOR PRINTING AND DRYING

(71) Applicant: HEIDELBERGER DRUCKMASCHINEN AG, Heidelberg (DE)

(72) Inventors: Wolfgang Schoenberger, Schriesheim (DE); Peter Hachmann, Weinheim-Hohensachsen (DE); Markus Moehringer, Weinheim (DE); Uwe Ernst, Mannheim (DE); Christian Hieb, Neuhofen (DE); Thomas Schmidt, Heidelberg (DE); Rolf Mueller, Nussloch (DE); Michael Sauer, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 16/395,539

(22) Filed: Apr. 26, 2019

(65) Prior Publication Data

US 2019/0329570 A1 Oct. 31, 2019

(30) Foreign Application Priority Data

Apr. 26, 2018 (DE) ..... 10 2018 206 497

(51) Int. Cl.
*B41J 11/00* (2006.01)
*B41M 7/00* (2006.01)

(52) U.S. Cl.
CPC ..... *B41J 11/002* (2013.01); *B41M 7/009* (2013.01); *B41M 7/0081* (2013.01)

(58) Field of Classification Search
CPC .... B41J 11/002; B41M 7/009; B41M 7/0081; B41M 7/0054
USPC ..... 347/101, 102, 104
See application file for complete search history.

(56) References Cited

U.S. PATENT DOCUMENTS

| | | | | |
|---|---|---|---|---|
| 2011/0115864 | A1 | 5/2011 | Rohde et al. | |
| 2011/0206841 | A1 | 8/2011 | Sabater Vilella | |
| 2016/0089904 | A1* | 3/2016 | Kitagishi | B41J 11/0005 347/104 |

FOREIGN PATENT DOCUMENTS

| | | | |
|---|---|---|---|
| CN | 101484319 | A | 7/2009 |
| CN | 103568481 | A | 2/2014 |
| CN | 105437802 | A | 3/2016 |
| CN | 105479942 | A | 4/2016 |
| CN | 205871473 | U | 1/2017 |
| DE | 102015204980 | A1 | 9/2016 |
| EP | 2258553 | A1 | 12/2010 |

(Continued)

*Primary Examiner* — An H Do
(74) *Attorney, Agent, or Firm* — Laurence A. Greenberg; Werner H. Stemer; Ralph E. Locher

(57) ABSTRACT

A method prints and dries a substrate where ink containing water and pigment is printed onto the substrate in an inkjet printing process. The substrate has an initial moisture content and absorbs at least water of the ink, causing the moisture content of the substrate to rise. Radiation selectively acting on the water molecules is applied in a first drying step and then radiation selectively acting on the pigment is applied in a second drying step in such a way that after completion of the two drying steps, the water of the applied ink has essentially completely evaporated and the substrate has essentially reattained its initial moisture content. In this manner optimum drying of substrates to which ink has been applied occurs.

10 Claims, 7 Drawing Sheets

(56) References Cited

FOREIGN PATENT DOCUMENTS

| | | | |
|---|---|---|---|
| EP | 3012110 | A1 | 4/2016 |
| EP | 3034309 | A1 | 6/2016 |

* cited by examiner

METHOD FOR PRINTING AND DRYING

CROSS-REFERENCE TO RELATED APPLICATION

This application claims the priority, under 35 U.S.C. § 119, of German application DE 10 2018 206 497.0, filed Apr. 26, 2018; the prior application is herewith incorporated by reference in its entirety.

BACKGROUND OF THE INVENTION

Field of the Invention

The invention relates to a method for printing and drying namely a process where ink containing water and pigment is printed onto a substrate in an inkjet printing process.

The technical field of the invention is the field of the graphic industry, in particular the field of applying and drying ink that contains water and pigment, i.e. the field of what is known as inkjet printing.

Various methods of treating inks on substrates, in particular of drying or curing ink, are known in the art, for instance infrared, hot-air, ultraviolet, high-frequency, or microwave treatments.

Each one of published, European patent applications EP 3 012 110 A1 and EP 3 034 309 A1 discloses an inkjet printing machine with a dryer that combines high-frequency and infrared (or hot-air) treatment. The aim is to achieve even drying of printed and unprinted locations on the substrate, i.e. drying without tension in the substrate. A problem that may occur, however, is that although the substrate may be without tension and free of waves ("cockling"), it may not be optimally dried.

SUMMARY OF THE INVENTION

Thus an object of the invention is to provide a technical solution that is an improvement over the prior art and in particular provides optimum drying of substrates printed with ink.

In the course of extensive printing laboratory experiments to attain the object of the invention, it has been found that optimum drying is attained when the substrate essentially has reattained its initial moisture content (moisture content before the treatment with water-containing ink). Drying beyond that point, i.e. down to a lower moisture content, has not been found optimal.

In accordance with the invention, the object is attained by a method that has the features described in the independent method claim. Advantageous and thus preferred further developments of the invention will become apparent from the dependent claims as well as from the description and drawings. In combination with one another, the features of the invention, of further developments of the invention, and of the exemplary embodiments of the invention also represent advantageous further developments of the invention.

The method for printing and drying of the invention is a method wherein ink that contains water and pigment is printed onto a substrate in an inkjet printing process. The substrate, for instance paper or cardboard, has an initial moisture content and absorbs at least the water of the ink, causing the moisture content of the substrate to rise. Radiation selectively acting on the water molecules, for instance HF or MW radiation, is applied in a first drying step and then radiation selectively acting on the pigment is applied in a second drying step in such a way that after completion of the two drying steps, the water of the applied ink has essentially completely evaporated and the substrate has essentially reattained its initial moisture content.

The invention advantageously provides optimum drying of substrates that have been printed with ink.

The invention relies on an expedient combination of two drying steps that have selective effects: the first drying step selectively and primarily acts on the water/the molecules thereof, whereas the second drying step selectively and thus primarily acts on the pigment. "Act" in this context is understood to mean that the energy introduced with every drying step is transmitted to the water molecules and to the pigment, respectively, at least to an extent that is sufficient for the respective drying effect.

An implementation of the method of the invention advantageously allows the printed substrate to be dried in an optimum way in which the substrate reattains its initial moisture content. "Initial moisture content" in this context is understood to be the moisture content that the substrate had before it was printed with water-containing ink. The method advantageously causes substrate locations that have different moisture contents, for instance printed and unprinted locations or printed and more or less printed locations (i.e. locations that have had more or less ink or water applied thereto) are evenly dried, ensuring that after completion of the drying process/drying steps, such locations have reattained their initial moisture content. After the drying process of the invention, there is no tension in the substrate and the substrate is advantageously neither smaller (shrunk) than larger (swollen) and fibers of the substrate (if there are any) are advantageously not dehydrated in an undesired way and consequently do not tend to break for instance in later further processing operations such as folding.

The method of the invention might be used to advantage in a corresponding way to treat (dry) different types of water-containing printing inks such as inks for use in flexographic printing.

Preferred further developments may be characterized by the following features:

a) initially using high-frequency radiation for instance preferably at 27.12 megahertz or microwave radiation for instance preferably at 2.45 gigahertz for drying;

b) continuing the drying process during a first defined period of time, for instance preferably between 0.5 and 3 seconds;

c) during the first defined period of time, drying locations on the substrate to which a large amount of ink has been applied in such a way that they are dehumidified faster quickly than locations on the substrate to which a small amount of ink has been applied;

d) subsequently using ultraviolet radiation, for instance preferably of a 285 nanometer wavelength for drying;

e) continuing the drying operation during a second defined period of time, for instance preferably between 0.1 and 3 seconds;

f) during the second defined period of time, drying locations on the substrate to which a large amount of ink has been applied in such a way that they are dehumidified faster than locations on the substrate to which a smaller amount of ink has been applied;

g) at least during the first drying step, transporting the substrate by means of grippers holding the substrate with gripper fingers and gripper pads of a non-metallic material in the process;

h) transporting by means of gripper bars made of a non-metallic material; and i) assisting transport by means of guide devices of a non-metallic material.

Other features which are considered as characteristic for the invention are set forth in the appended claims.

Although the invention is illustrated and described herein as embodied in a method for printing and drying, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE INVENTION

Figure 1:
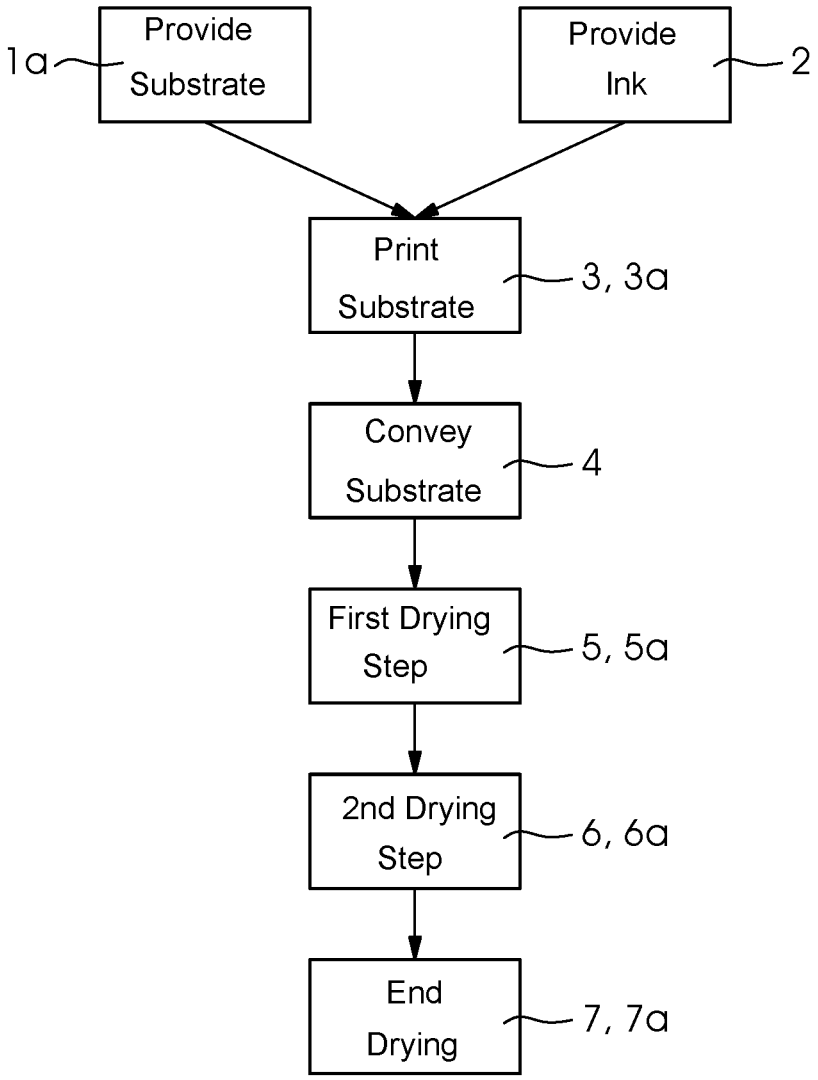
FIG. 1 is a flow chart of a method for printing and drying according to the invention.

Referring now to the figures of the drawings in detail and first, particularly to FIG. 1 thereof, there is shown a flow chart of a preferred exemplary embodiment of a method of the invention.

In a step 1*a*, the substrate 1 to be printed on is provided, for instance as a stack of paper sheets in a feeder of an inkjet printing machine 8 (see FIG. 3 below illustrating an inkjet printing machine 8 implementing the method) and with a relative initial moisture content of between 3% and 6%, for example.

In a step 2, ink for printing on the substrate 1 is provided, e.g. by means of an ink supply system for an ink printing unit 9 of the inkjet printing machine 8. It is possible to provide multiple different inks for instance of different colors such as CMYK or CMYOGVK. At least one of the inks contains water (i.e. it is what is known as a water-based or aqueous ink) and pigment or different pigments.

In a step 3/3*a*, the at least one ink containing water and pigment is printed onto the substrate 1 in an inkjet printing process (preferably a drop-on-demand process) and in accordance with a digital image. In this process, water is introduced into the substrate, increasing the moisture content of the substrate. If the substrate is absorbent, preferably paper or cardboard, it will absorb the water at last partly into its fiber composite.

Figure 3:
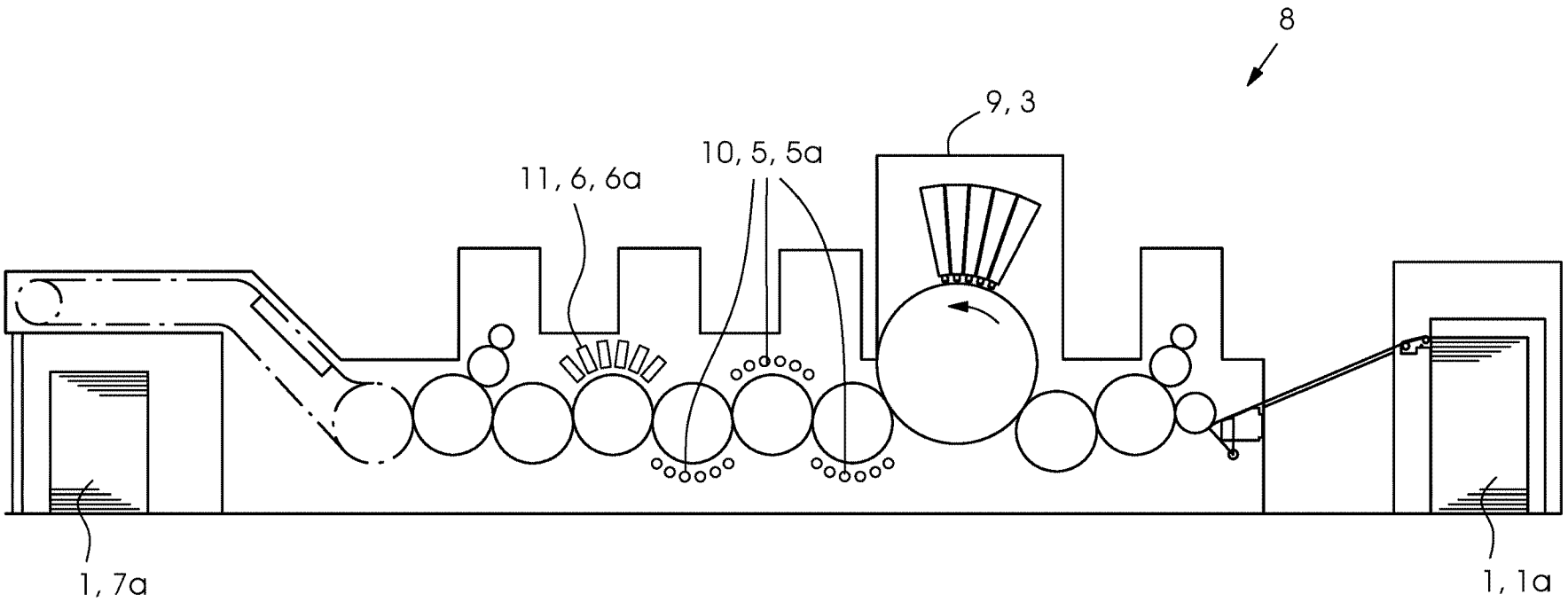
FIG. 3 is a diagrammatic, side view of a printing press.

In an optional step 4, the printed substrate 1 is conveyed along a conveying path, for instance by means of transport cylinders disposed downstream of the printing unit 9 as shown in FIG. 3 or, alternatively, by means of tablets or a belt/belts. The respective transport system preferably includes grippers 12 and/or holds the substrate by suction.

Step 5/5*a* is the first drying step in which preferably HF (electromagnetic high-frequency) or MW (electromagnetic microwave) radiation is applied. Such radiation selectively acts on the water/the water molecules in the applied ink. To achieve this, the frequency of the electromagnetic radiation is selected/adapted in a suitable way; for instance, it is high frequency radiation of preferably 27.12 megahertz. FIG. 3 illustrates an example of at least one HF dryer 10 disposed along the conveying path.

In a step 6/6*a*, the second drying step takes place, preferably using UV (electromagnetic ultraviolet radiation). Such radiation selectively acts on the pigment or pigments in the applied ink. To achieve this, the wavelength of the electromagnetic radiation is selected/adapted to the pigment in a suitable way; for instance preferably between approximately 300 and 400 nanometers, in particular 385 nanometers. At approximately 300 nanometers, inks of different colors, i.e. inks with different pigments absorb at approximately the same level (82% to 89%). However, at present the manufacturing of LED dryers with a wavelength of 300 nanometers is expensive. At 385 nanometers, the absorption of different inks fluctuates between 70% and 88%, but the corresponding LED dryers can be manufactured at justifiable expense. At wavelengths below 400 nanometers, white paper hardly absorbs at all. FIG. 3 illustrates an example of at least one UV dryer 11 disposed along the conveying path.

In a step 7/7*a*, the two drying steps 5 and 6 have been completed (end of drying process) and the dried substrate 1 has a moisture content that essentially corresponds to the initial moisture content at step 1*a*. Subsequently the substrate is delivered, for instance to a stack in a delivery of the inkjet printing machine 8.

Figure 2:
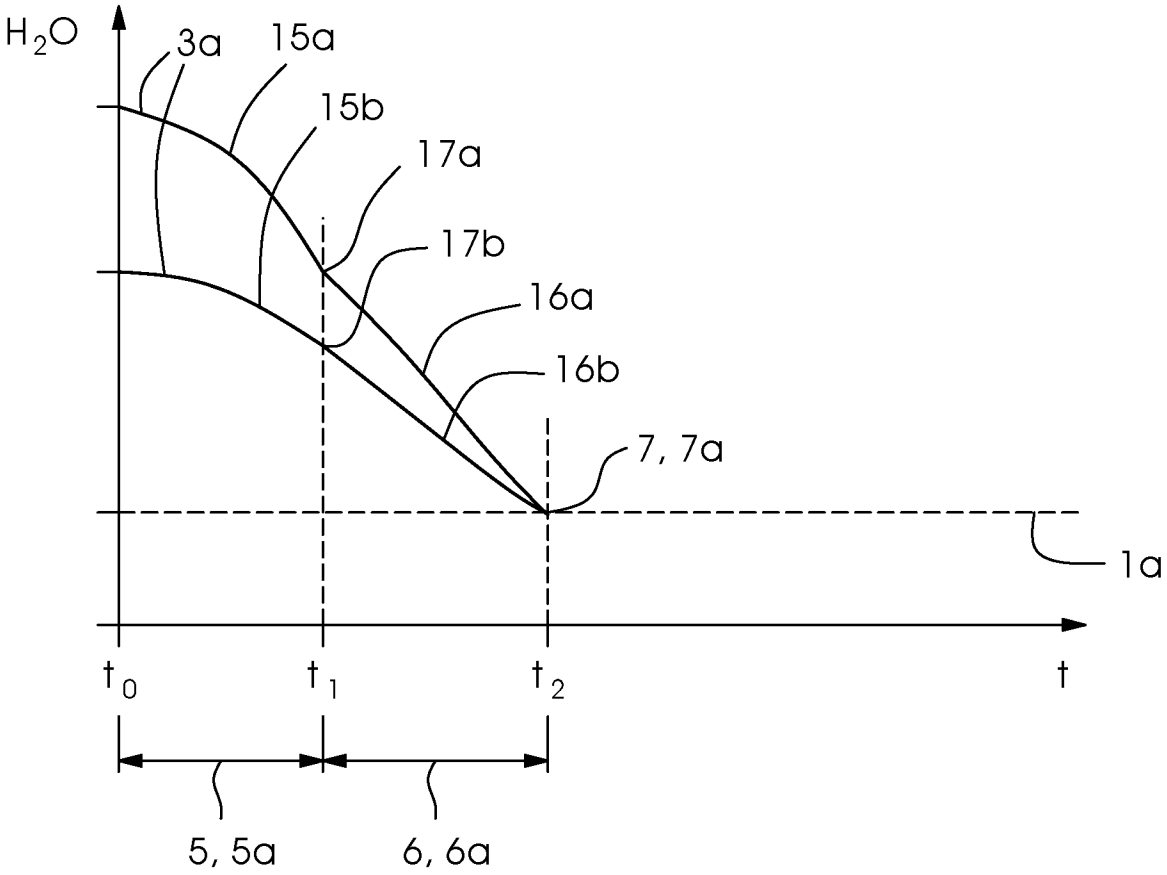
FIG. 2 is a graph illustrating a course of a drying operation.

FIG. 2 illustrates the course of the drying operation during drying steps 5 and 6. The horizontal axis is the time axis (T), for instance in seconds; the vertical axis corresponds to the relative moisture content of the paper ($H_2O$), e.g. in percentages. The first drying step 5/5*a* takes place during the first period of time from $t_0$ to $t_1$; the second drying step 6 or rather 6*a* takes place during the second period of time from $t_1$ to $t_2$. The dashed horizontal line corresponds to the initial moisture content 1*a* of the substrate 1 preferably at room temperature.

FIG. 2 illustrates two curves: The upper curve sections 15*a* and 16*a* illustrates an example where a large amount of ink has been applied i.e. a large amount of moisture has been introduced, whereas the lower curve sections 15*b* and 16*b* illustrate an example where a small amount of ink has been applied, i.e. only a small amount of moisture has been introduced. "A large amount of" and "a small amount of" are to be understood as relative to one another.

The drying process starts at an instant $t_0$. The transition from HF (or, alternatively, MW) drying 5 to UV drying 6 at a time $t_1$ is indicated by reference symbol 17*a* in the upper curve and by reference symbol 17*b* in the lower curve. The end of the drying process 7/7*a* at an instant $t_2$ is likewise shown.

Figure 4:
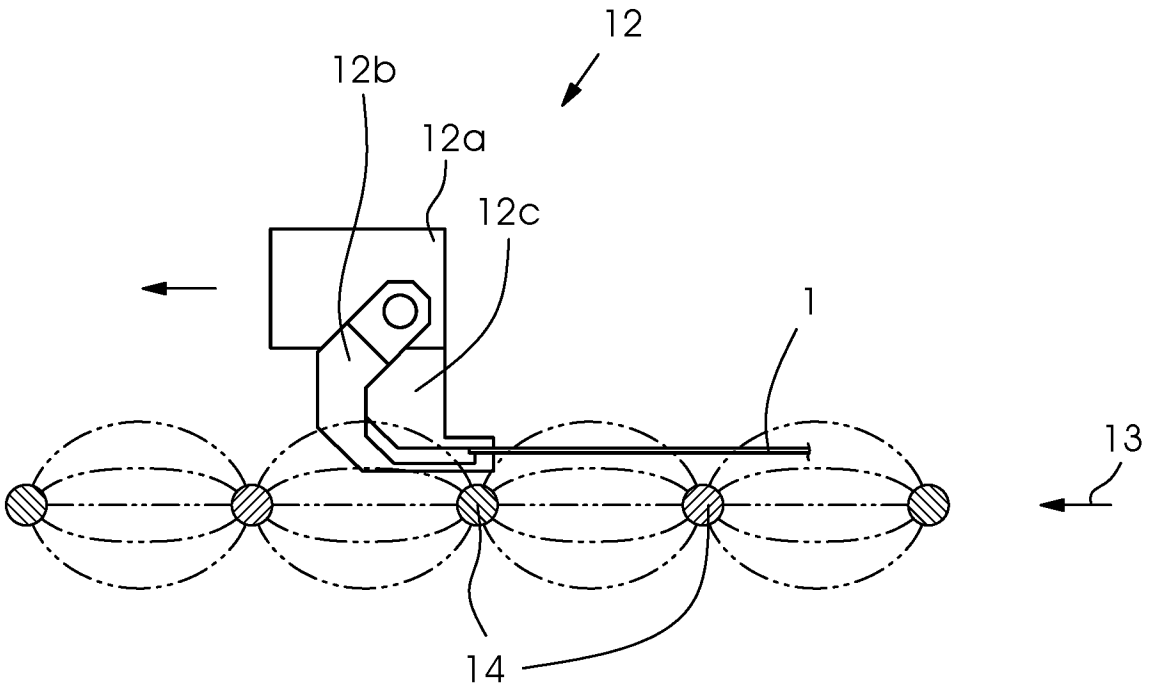
FIG. 4 is an illustration of a first embodiment of a gripper.

FIG. 4 shows a gripper 12 of a transport system for transporting the substrate 1, which is preferably a sheet of paper. The gripper (or a number of such grippers) is disposed on a gripper bar 12 movable along the conveying path and contains at least one gripper finger 12*b* and at least one gripper pad 12*c* interacting with the gripper finger 12*b* for holding, preferably clamping.

The gripper finger 12*b* and the gripper pad 12*c* are made of a non-metallic material, i.e. a material that has a low dielectric loss factor. Therefore, they may easily, i.e. without disruption, pass through the electromagnetic field, in particular the HF field 13 (alternatively: the MW field) that is generated by electrodes 14. The gripper bar 12*a* passes outside the field and may therefore be made of a metallic material.

Figure 5:
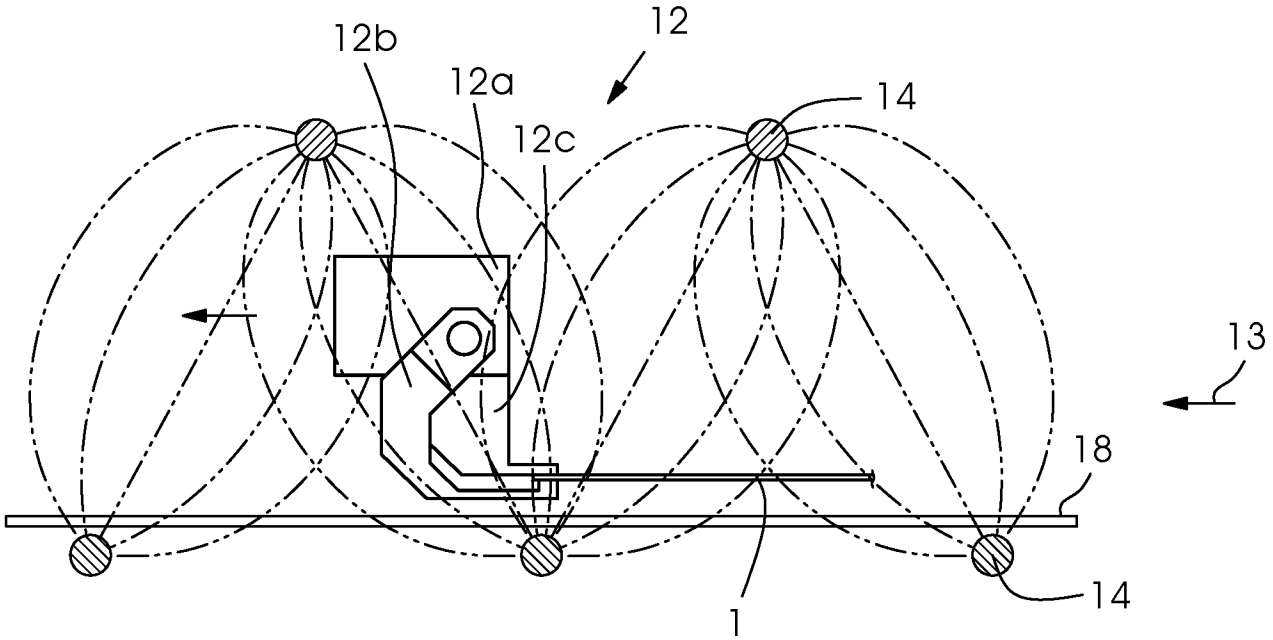
FIG. 5 is an illustration of a second embodiment of the gripper.

FIG. 5 illustrates an alternative with a gripper 12 whose gripper bar 12*a* is likewise made of a non-metallic material and which may therefore likewise pass through the field 13 without any difficulty. In addition, FIG. 5 illustrates a guide device 18 that is made of a non-metallic material and may therefore be disposed in the region of the field 13 without any problems.

Figure 6A:
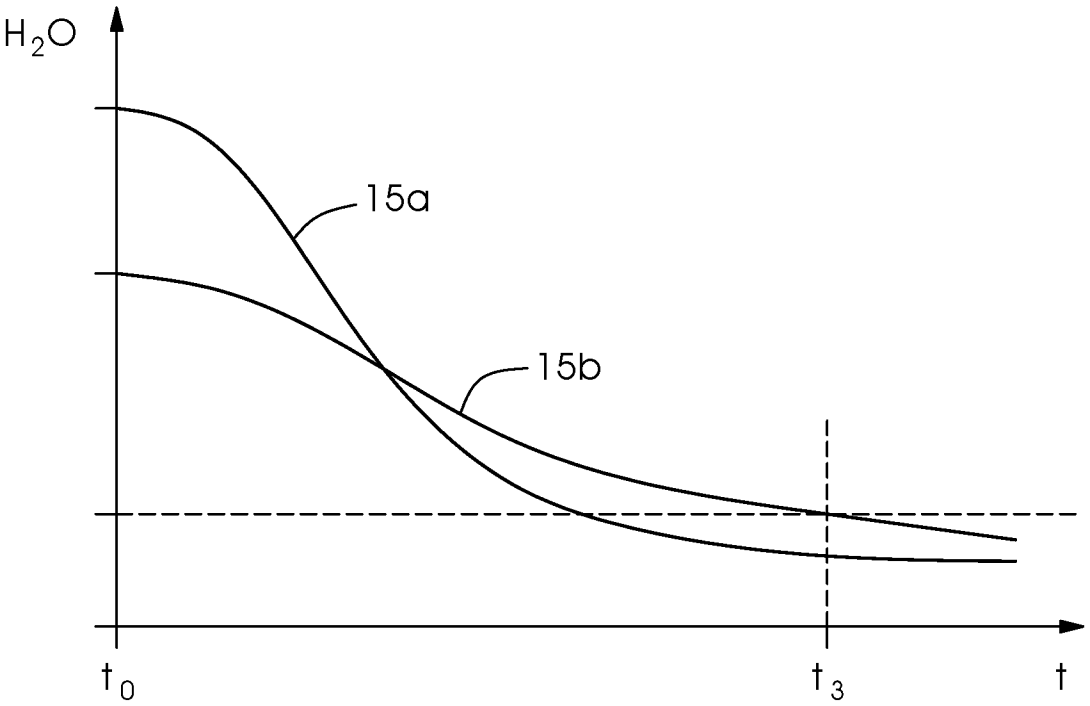
FIG. 6A is a graph showing a HF drying process.
Figure 6B:
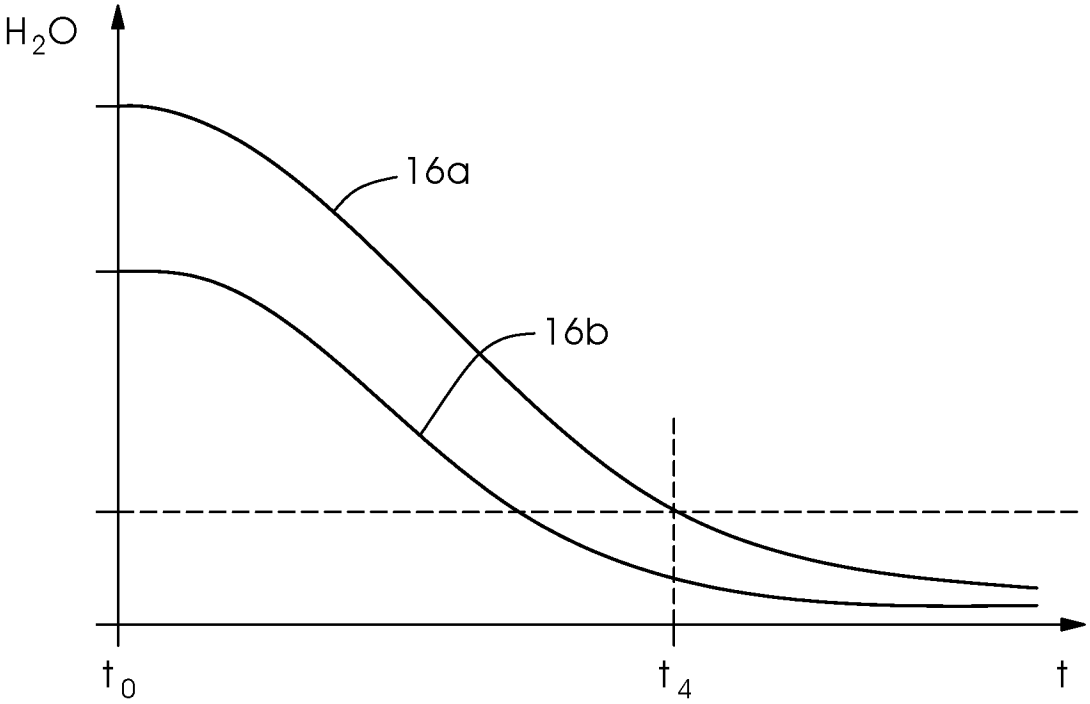
FIG. 6B is a graph showing a UV drying process.

In a way similar to FIG. 2, FIGS. 6A and 6*b* illustrate two drying processes (for a large amount of ink and a small amount of ink), but in a case where only one type of radiation is used: in FIG. 6A, it is HF drying and in FIG. 6B it is UV drying. It is shown that drying with HF alone does not provide optimum drying results and neither does drying with UV alone as at the end of the respective drying process at times $t_3$ and $t_4$, respectively, there are locations on the substrate 1 that have been dried too much, i.e. to a point below the initial moisture content of the substrate 1.

FIG. 6A illustrates the moisture development of the paper in an HF drying process. HF acts on the water contained in the ink and causes dipoles and ions to rotate and vibrate, resulting in frictional heat. In the beginning, locations with a large amount of ink and water have the highest moisture content. In the HF field, a large amount of energy is introduced at these locations and the ink becomes particularly warm. Therefore, the moisture loss in the drying process is particularly high over time (the curve falls steeply). If more and more water evaporates, less energy is introduced, slowing the loss of moisture down until at some point the process stops due to a lack of moisture. Since at this point the paper also gets heated up due to heat conduction, the moisture content of the paper ends up being lower than the original natural paper moisture at room temperature.

Locations that have less ink absorb much less energy because the HF field cannot concentrate as much in these locations and because there is less absorbent mass. These locations heat up less easily on the cold substrate. Therefore, less moisture is lost over time and temperatures do not rise as much as at locations with a large amount of ink. Therefore, the drying process in the HF field actually takes significantly longer than at locations with a large amount of ink.

If the substrate was left in the dryer for a long time, at some point locations with a smaller amount of ink would be similarly dry as locations with a large amount of ink. Yet the time required to achieve this is approximately 10 seconds, which is a long period of rest or requires a long drying section and is thus uneconomical.

An unprinted substrate absorbs hardly any energy at all. No heating effect occurs and the moisture content is maintained.

The figure also shows the end of the drying process when all printed areas have a moisture content that equals or is below the initial moisture content.

A drying process using microwaves basically works in the same way because microwaves likewise mainly act on the water. However, at the higher frequencies, the substrate such as paper will absorb more energy, causing unprinted areas to heat up slightly more than with HF.

FIG. 6B illustrates the drying development using UV radiation (e.g. at a wavelength of 385 nm). Here, the drying energy is absorbed by the pigments. Thus the absorbed power is constant during the drying process even though the ink gets dryer and dryer because the number of pigment particles remains the same during the drying process. For a large part, the moisture loss in the substrate is in proportion to the time. If UV irradiation continues once the water in the ink has evaporated, the dry pigments will continue to absorb energy and the substrate will dry much farther below the initial moisture content than with HF.

Locations with a large amount of ink and consequently many pigments will absorb a little more energy than locations with a smaller amount of ink, causing the former to lose more moisture per time. Since locations with a small amount of ink contain less moisture, they will nevertheless be dry faster (compared to HF).

Unprinted locations do not absorb UV; thus unprinted locations keep the initial moisture content.

Therefore neither HF nor UV alone are sufficient to dry printed locations with a large amount of ink and printed locations with a small amount of ink in such a way that in the end, the substrate will have the initial moisture content at every location.

Therefore, the invention uses the combination of the two selective drying processes as shown in FIG. 2. (At instant $t_0$,) the drying process starts with HF drying. Moisture is quickly reduced/removed especially in locations with a large amount of ink/water, i.e. these locations lose more moisture (amount of water) per unit of time than locations with a small amount of ink/water. Shortly before the moisture curves of locations with a large amount of ink and of locations with a small amount of ink intersect, the HF drying process is stopped (instant $t_1$). The moisture of locations with a large amount of ink has been significantly reduced and is only just above the moisture of locations with a small amount of ink. This is when the UV drying process sets in (likewise instant $t_1$). Locations with a large amount of ink and a large amount of pigment now lose moisture more quickly, i.e. these locations, lose more moisture (amount of water) per unit of time than locations with a small amount of ink/pigment, which is why the curve falls more quickly. Between $t_0$ and $t_1$, moisture is removed faster than between $t_1$ and $t_2$ (i.e. more water per unit of time). If an expedient time is chosen for the transition between HF and UV drying, the drying curves of locations with a large amount of ink and of locations with a small amount of ink will intersect precisely at the initial moisture content. This is the point where the UV drying process ends (instant $t_2$); all locations on the substrate have reattained the initial moisture content.

The optimum times $t_1$ to $t_3$ for different combinations of inks (different amounts of water, different pigments, different amounts of pigment) and substrates (e.g. different types of paper and/or papers of different thicknesses) may be determined in advance in test runs (printing, drying, and assessing the drying results) and made available for the drying process in accordance with the invention. A digital computer with a digital memory may be provided for this purpose—a computer that controls the dryer or is connected to a dryer control.

The following is a summary list of reference numerals and the corresponding structure used in the above description of the invention:

1 substrate
1*a* providing the substrate with an initial moisture content
2 providing ink
3 printing
3*a* increasing the moisture content of the substrate
4 conveying the substrate
5 first drying step (HF/MW)
5*a* reducing the moisture content of the substrate
6 second drying step (UV)
6*a* reducing the moisture content of the substrate
7 end of the drying process
7*a* attaining the initial moisture content of the substrate
8 printing machine

9 printing unit
10 first dryer (HF/MW)
11 second dryer (UV)
12 gripper
12*a* gripper bar
12*b* gripper finger
12*c* gripper pad
18 guide device
13 HF field
14 electrodes
15*a* moisture development (HF/MW, large amount of ink)
15*b* moisture development (HF/MW, small amount of ink)
16*a* moisture development (UV, large amount of ink)
16*b* moisture development (UV, small amount of ink)
17*a* moisture development transition
17*a* moisture development transition
18 guide device
$t_0$ point in time: beginning of first drying step
$t_1$ point in time: end of first drying step/beginning of second drying step
$t_2$ point in time: end of second drying step
$t_3$ point in time: end of HF drying
$t_4$ point in time: end of UV drying step

The invention claimed is:

1. A method for printing and drying a substrate, which comprises the steps of:

printing an ink containing water and pigment onto the substrate in an inkjet printing process, the substrate having an initial moisture content before the inkjet printing process and absorbing at least the water of the ink, causing the initial moisture content of the substrate to rise to a changed moisture content;

performing a drying process which includes the sub-steps of:

applying radiation which selectively acts on water molecules in a first drying step; and applying additional radiation which selectively acts on the pigment in a second drying step in such a way that after completion of the first and second drying steps, the water of the ink applied has essentially completely evaporated and the substrate has essentially reattained the initial moisture content.

2. The method according to claim 1, which further comprises using high-frequency radiation or microwave radiation as the radiation during the first drying step uses.

3. The method according to claim 2, wherein the first drying step occurs during a first defined period of time.

4. The method according to claim 3, wherein during the first defined period of time, drying first substrate locations to which a large amount of the ink has been applied in such a way that the first substrate locations are dehumidified faster than second substrate locations to which a smaller amount of the ink has been applied.

5. The method according to claim 1, wherein a subsequent drying step, of the first and second drying steps, uses ultraviolet radiation.

6. The method according to claim 5, wherein the second drying step occurs during a second defined period of time.

7. The method according to claim 6, wherein during the second defined period of time, drying first substrate locations to which a large amount of the ink has been applied in such a way that the first substrate locations are dehumidified faster than second substrate locations to which a smaller amount of the ink has been applied.

8. The method according to claim 1, which further comprising during at least the first drying step, transporting the substrate by means of grippers holding the substrate with gripper fingers and gripper pads of a non-metallic material.

9. The method according to claim 8, wherein the transporting step is achieved by means of gripper bars made of a non-metallic material.

10. The method according to claim 9, wherein transport of the substrate is assisted by guide devices of a non-metallic material.

* * * * *